US005232169A

United States Patent [19]

Kaneko et al.

[11] Patent Number: 5,232,169

[45] Date of Patent: Aug. 3, 1993

[54] CONTINUOUS AIR-SWEPT TYPE PLANETARY BALL MILL

[75] Inventors: Kantaroh Kaneko; Mutsuhiro Kawashima, both of Osaka, Japan

[73] Assignee: Kurimoto, Ltd., Osaka, Japan

[21] Appl. No.: 740,090

[22] Filed: Aug. 5, 1991

[30] Foreign Application Priority Data

Nov. 27, 1990 [JP] Japan ..... 2-326989

[51] Int. Cl.[5] ..... B02C 17/08

[52] U.S. Cl. ..... 241/57; 241/70; 241/171; 241/175

[58] Field of Search ..... 241/54, 57, 70, 171, 241/175

[56] References Cited

U.S. PATENT DOCUMENTS

| | | | |
|---|---|---|---|
| 1,053,084 | 2/1913 | Capen | 241/70 X |
| 2,937,814 | 5/1960 | Joisel | 241/175 |
| 3,223,336 | 12/1965 | Wienert | 241/174 X |
| 3,529,780 | 9/1970 | Wilkinson, Jr. | 241/175 X |

FOREIGN PATENT DOCUMENTS

| | | | |
|---|---|---|---|
| 0814453 | 3/1981 | U.S.S.R. | 241/175 |
| 1358990 | 12/1987 | U.S.S.R. | 241/175 |

*Primary Examiner*—Frank T. Yost
*Assistant Examiner*—Raymond D. Woods
*Attorney, Agent, or Firm*—Jones, Tullar & Cooper

[57] ABSTRACT

A planetary ball mill in which a plurality of mill pots revolve by receiving a rotational force from a main shaft, while rotating on their own axes. A feed is continuously supplied to the mill pots so that ground particles are discharged out of the mill pots utilizing air flow. A partition for dividing a grinding chamber from a discharge pipe is disposed on the discharge side of the chamber of each mill pot so as to permit only the feed already ground to pass through. The feed having passed through the partition is collected by way of a discharge chute not rotating but surrounding a discharge pipe which rotates relative to the discharge chute to generate a negative pressure which assists the discharge of ground feed from each mill pot.

7 Claims, 4 Drawing Sheets

CONTINUOUS AIR-SWEPT TYPE PLANETARY BALL MILL

BACKGROUND OF THE INVENTION

1. Field of the Invention

The present invention relates to a planetary ball mill and, more particularly, to a continuous air-swept type planetary ball mill in which feed to be ground is supplied and ground continuously.

2. Prior Art

In a generally known construction of a planetary ball mill, a plurality of mill pots respectively revolving following the rotation of a main shaft are disposed evenly around the main shaft (symmetrically in the case of two mill pots and radially with equal distance from the main shaft in the case of three or more), and each of these mill pots also rotates on its own axis. To be more specific, it is representative that a planetary gear is mounted on the periphery of a mill pot revolving together with the main shaft, and a sun gear mating with this planetary gear is separately rotated or fixed, thereby the pot is caused to revolve around the sun gear and rotate on its own axis simultaneously.

In general tumbling ball mills, balls serving as grinding media and feed to be ground undergo a cascade motion in a cylinder, and the feed is ground as a result of compressive collapse and frictional abrasion due to gravitational drop of the balls. On the other hand, in planetary type ball mills, the grinding speed is remarkably improved as compared with the tumbling ball mill by the synergistic effect between centrifugal force due to revolution and rotation, and Coriolis' force, and this results in the production of fine particles in a short time.

In particular, grinding force by high speed revolution and rotation is remarkable in planetary ball mills. For example, when operating for a few minutes after feeding silica of several millimeters in grain size, fine particles of several microns average diameter can be obtained.

As mentioned above, a planetary ball mill is characterized by the exhibition of strong grinding performance in a short time. A serious problem, however, exists in the conventional swept-type ball mill that utilizes air flow through the mill for continuously supplying a feed this problem being that, collection of the ground feed after grinding is difficult.

More specifically, in a generally known configuration of a conventional planetary type ball mill, a feed which has been already ground inside of a mill pot is guided from a discharge port of the mill pot to a discharge chute, and then is further carried over to a product discharge zone utilizing air flow. A sealing member is usually interposed between the revolving part including the mill pot rotating on its own axis, and the discharge chute so as to prevent an air leak which negatively affects the air-swept function. A problem, however, exists in that complete prevention of air inflow is very difficult because of the large diameter of the sealing member.

In the prior art as disclosed in the Japanese Patent Publication (examined) No. 34-7493, the feed which has been ground in the mill pot is transferred to a collector through an output tube, common basic portion and suction tube by utilizing air flow; then the ground product is collected after separating the air.

In the prior art of the above construction, since the output tube and common section revolve together with the main shaft while receiving the drive force from a motor, it is difficult to minimize a certain qunatity of air inflow from outside to inside at the connecting part between the revolving and rotating mill pot, and the output tube, as well as at the connecting part between the output tube and the stationary suction tube, in spite of the sealing. There will be another possibility that air is blown from the connecting part into the inside in the form of seal air. Accordingly, the quantity of air running through the suction tube is largely increased as compared with the quantity of air passing through the mill pot. As a result, the capacity of the collector and a rear end blower should be increased to meet such a situation.

Moreover, since the air quantity passing through the mill pot is largely variable depending upon the state of sealing, if inflow of air from the outside is large, the air quantity passing through the mill pot is reduced whereby the residence time of feed in the mill pot is prolonged, eventually resulting in over-grinding and agglomeration of the feed thereby negatively affecting the product quality. On the other hand, if the air quantity passing through the mill pot is excessively large, there is a possibility that a coarser feed is will be discharged as the final product without sufficient grinding. Anyway, there remains a further problem of mixing some product with the final product that is not conforming to a predetermined quality standard of the product.

SUMMARY OF THE INVENTION

Accordingly, the present invention was made to solve the above-discussed problems and has an object of providing a new continuous air-swept type planetary ball mill in which air quantity passing through mill pots is more constant and less variable so that the grain size and quality of the product is kept to a certain level, and the size of necessary equipment such as a blower attached to the rear end can be smaller than in conventional ball mills.

To accomplish the foregoing object, a continuous air-swept type planetary ball mill in accordance with the present invention comprises: a partition vertically mounted on the discharge side of a grinding chamber of each mill pot and serving as a division from the grinding chamber, said partition permitting only a part of the feed already ground to pass therethrough; and a discharge chute not rotating on its own axis and covering a front end of a plurality of discharge members disposed radially from a feed passing zone, said discharge chute being communicated with a product collecting zone.

The continuous air-swept type planetary ball mill cf above mentioned construction performs a peculiar function particularly in the product discharge zone. That is, only a feed which has been sufficiently ground to be qualified as a product F is suctionally moved from the center of the partition to the adjacent product discharge zone utilizing air-swept action, while grinding media of heavy weight and large size, and feed not yet ground cannot reach the feed passing zone due to centrifugal force.

In the product discharge zone, each of the discharge members disposed radially from the axis of rotation also rotates on its own axis in the same manner as the mill pots. However, since the periphery of the discharge member is surrounded or covered by the stationary discharge chute not rotating, a pressure gradient is generated in such a manner as to be lower in circumferential direction, and this pressure gradient is additionally combined with the negative pressure gradient performing an air swept action toward the product discharge zone, thereby further intensifying the required air-swept operation.

As a result of the mentioned construction of the air-swept type continuous planetary ball mill which intensifies the air-swept function as mentioned above, a high quality product of desirable particle size distribution can be stably and constantly obtained.

In other words, to satisfy the same conditions as the prior art, the capacity of air blowing quantity and air pressure of a blower can be made smaller than in the prior art.

Other objects, features and advantages of the invetion will becomes apparent in the course of the following description with reference to the accompanying drawings.

BRIEF DESCRIPTION OF THE DRAWNINS

In the drawings forming a part of the present application,

FIG. 1 is a front view showing an embodiment of the present invention;

FIGS. 2(*a*) and (*b*) are respectively a sectional view taking along the line A—A and a sectional view taking along the line B—B of FIG. 1;

FIG. 3 is a vertical sectional view showing a part of another embodiment of the invention; and FIGS. 4(*a*) and (*b*) are sectional views taking along the line C—C respectively showing different embodiments.

DESCRIPTION OF THE PREFERRED EMBODIMENTS

Figure 1:
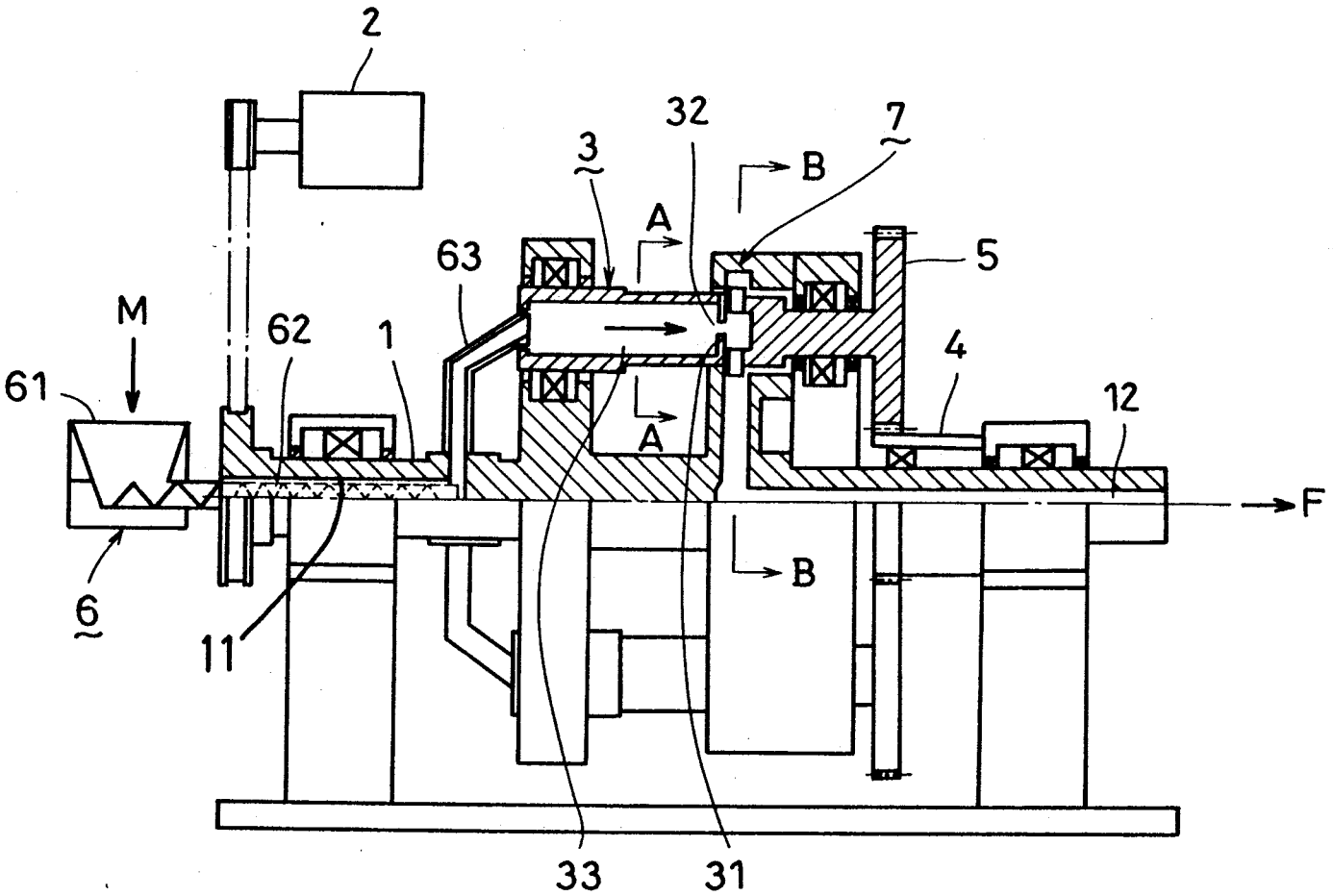

FIG. 1 is a front view illustrating an embodiment of the present invention, and FIGS. 2(A) and (B) are sectional views respectively taking along the lines A—A and B—B of FIG. 1.

In the basic construction of this embodiment as shown in FIG. 1, a main shaft 1 is rotated by a motor 2, and revolves a plurality of mill pots 3 disposed around the main shaft with equal distances between one and the other.

The main shaft 1 rotated by the motor 2 is provided with a sun gear 4 on the periphery, and this sun gear 4 mates with a planetary gear 5 to cause the mill pots 3 to rotate on their own axes. Thus, the mill pots 3 revolve at high speed around the main shaft while rotating on their own axes.

A feed M is fed into a hopper 61 of a screw feeder 6, then utilizing rotation of a screw 62, a predetermined quantity of feed M is continuously supplied to the inside of the mill pots 3 from a charge hole 11 provided through the central axis of the main shaft 1 by way of a supply pipe 63, and is ground by a moving grinding media in each mill pot.

From the viewpoint of permiting only the well-ground feed to pass through from the grinding chamber, it is preferable that partition 31 be provided having a center hole 32 therein. It is also preferable that any or all surface of the partition 31 is formed of a screen. It is equally preferable that a discharge chute 73 is secured to the main shaft and communicated with a product collection zone by way of a discharge hole 12 provided through the axis of the main shaft.

FIGS. 2(A) and (B) are sectional views both showing the embodiment.

Figure 2:
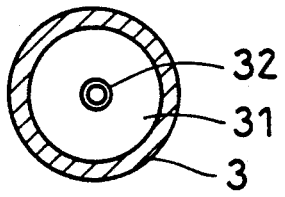
Figure 2:
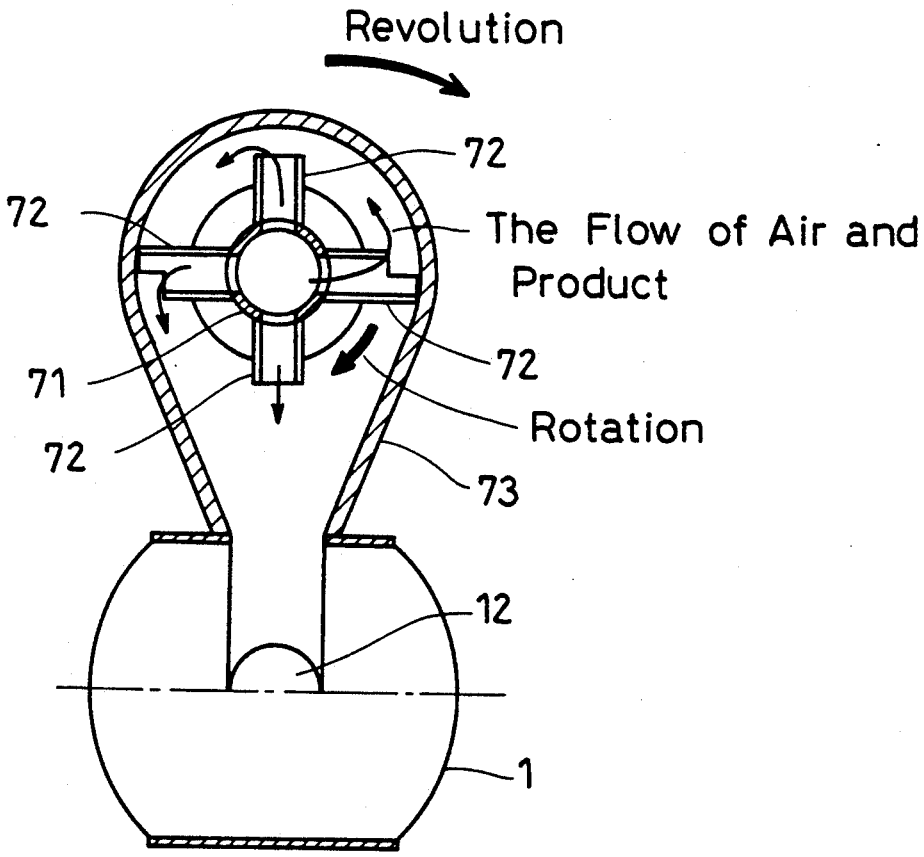

FIG. 2 (A) is a vertical sectional view of the grinding chamber 33 of a mill pot 3, and in which shown are the partition 31 vertically mounted on the discharge side of the mill pot and the center hole 32 for the feed F provided through the center of the partition. FIG. 2(B) is a vertical sectional view illustrating the product discharge zone 7, and this product discharge zone 7 comprises a rotation part composed of a center cylinder 71 fixed to the partition 31 and a plurality of discharge pipes 72 (four pipes in this embodiment) secured from the center cylinder radially in circumferential direction, and a non-rotation part of the discharge chute 73 surrounding or covering each front end of the discharge pipe. In this embodiment, the discharge chute 73 is communicated with the discharge hole 12 provided through the axis of the main shaft 1 and, passing through this route and utilizing air flow, the feed is carried over to an external product collection zone (not illustrated).

Other than the mentioned embodiment shown in FIGS. 2(A) and (B), it is also preferable that any or all surface of the partition 31 is formed of a screen so as to permit only the feed after having been ground to pass from the grinding chamber 33 to the product discharge zone 7.

Figure 3:
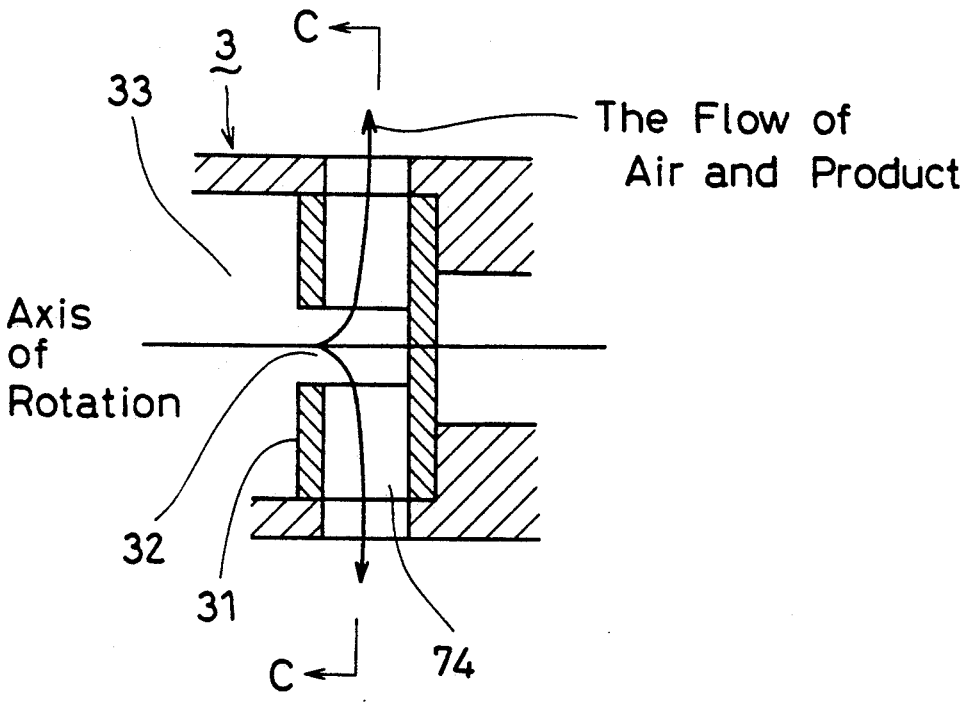
Figure 4:
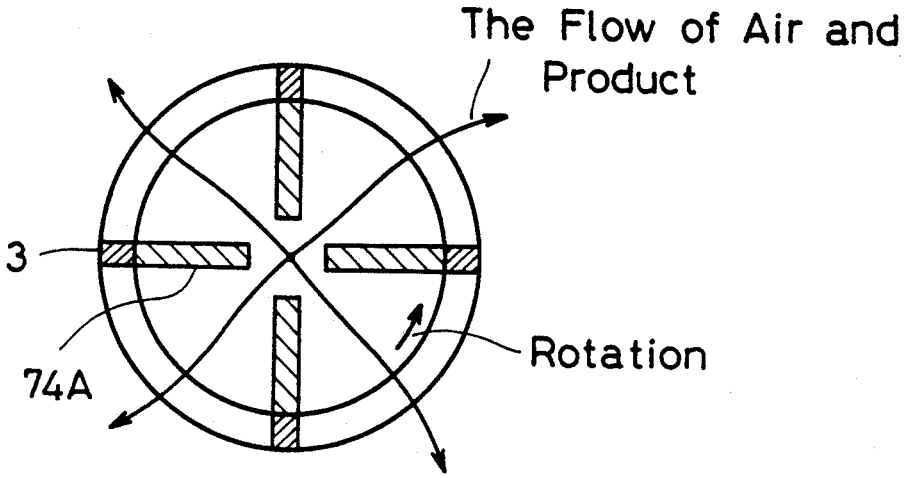
Figure 4B:
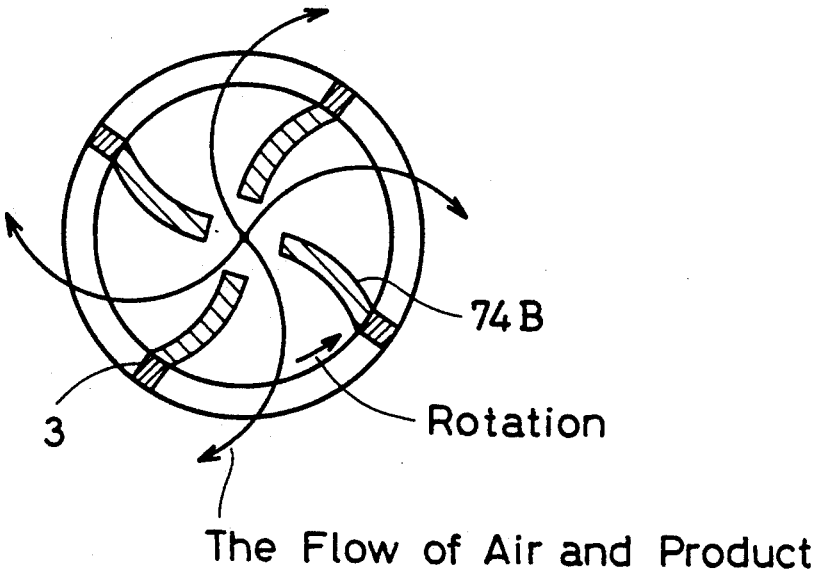

Furthermore, for the radial discharge member in the product discharge zone, it is also preferable to employ a vane type member as shown in FIG. 3 and FIGS. 4(A) and (B) other than the mentioned discharge pipe. More specifically, as shown in FIG. 3, discharge vanes 74 are radially secured next to the partition 31, and the peripheral portions thereof are provided with an opening facing to the discharge vanes 74. With regard to the discharge vanes, flat discharge vanes 74A illustrated in FIG. 4(A) and circular arc-shaped discharge vanes 74B illustrated in FIG. 4(B) are both satisfactory alternatives. Any of these two types of discharge vanes 74A, 74B perform a satisfactory function as if a plate fan or turbo fan is attached to the discharge side.

The embodiment of the above mentioned construction performs a peculiar effect such that, since the front end of the discharge pipe 72 rotates in the vicinity of the inner wall of the circular arc part of the discharge chute 73, the product discharge zone is prevented from adhesion of fine particles or cumulative agglomeration.

It is to be understood that the present invention is not limited to the foregoing description and various changes and modification may be made in the invetion without departing from the spirit and scope thereof.

What is claimed is:

1. A continuous air-swept type planetary ball mill including a plurality of mill pots which are revolvable by receiving a rotational force from a main shaft, and are disposed around the main shaft with equal distance between one mill pot and another, each said mill pot being rotatable on its own axis, and in which a feed supplied from a feed supply zone revolving together with the mill pots is efficiently ground, said ball mill further comprising:

a partition vertically mounted on a discharge side of a grinding chamber of each mill pot and serving as a divider from the grinding chamber, said partition permitting only a feed already ground to be discharged therethrough; and a discharge chute not rotating on its own axis and covering a front end of each of a plurality of discharge members disposed radially from a feed passing zone so that a negative pressure gradient will be generated in the discharge members when they rotate relative to the discharge chute to assist the discharge of ground feed from each said mill pot, said discharge chute being communicated with a product collecting zone.

2. A continuous air-swept type planetary ball mill according to claim 1, wherein a center hole is provided in said partition for passing ground feed therethrough.

3. A continuous air-swept type planetary ball mill according to claim 2, wherein said discharge chute is secured to the main shaft and communicated with the product collecting zone by way of a discharge hole provided through a central axis of the main shaft.

4. A continuous air-swept type planetary ball mill according to claim 1, wherein said discharge chute is secured to the main shaft and communicated with the product collecting zone by way of a discharge hole provided through a central axis of the main shaft.

5. A continuous air-swept type planetary ball mill comprising:

a rotatable main shaft;

at least one mill pot rotatably mounted to said main shaft at a position radially displaced from a central axis of said main shaft, said mill pot having an inlet end for receiving feed to be ground and a discharge end for discharging ground feed;

means to rotate said mill pot on its own axis relative to said main shaft;

a partition vertically mounted at said discharge end of said mill pot for permitting only ground feed to be discharged from said mill pot;

a radial discharge member disposed at said discharge end of said mill pot, said discharge member having a plurality of outwardly facing outlets; and, a discharge chute disposed on said main shaft and surrounding said radial discharge member in close proximity to said plurality of outlets, wherein a negative pressure gradient is formed across said outlets as said radial discharge member rotates relative to said discharge chute to assist the discharge of ground feed from said mill pot.

6. The continuous air-swept type planetary ball mill of claim 5, wherein a center hole is provided in said partition through which only ground feed will pass.

7. The continuous air-swept type planetary ball mill of claim 5, wherein said discharge chute is communicated with a product collecting zone by way of a discharge hole provided through the central axis of the main shaft.

* * * * *